US005809923A

United States Patent [19]

Yilmaz

[11] Patent Number: 5,809,923

[45] Date of Patent: Sep. 22, 1998

[54] APPARATUS FOR CONTROLLING THE BUOYANCY AND DRAFT OF A VESSEL

[76] Inventor: G. George Yilmaz, 28202 Meadowlark La., Bonita Springs, Fla. 34134

[21] Appl. No.: 772,603

[22] Filed: Dec. 23, 1996

[51] Int. Cl.[6] ..... B63B 1/00

[52] U.S. Cl. ..... 114/61; 114/362

[58] Field of Search ..... 114/61, 39.1, 143, 114/362

[56] References Cited

U.S. PATENT DOCUMENTS

| | | | |
|---|---|---|---|
| 2,850,747 | 6/1958 | Bouchard, Sr. | 114/61 |
| 4,044,703 | 8/1977 | Kurtz | 114/143 |
| 4,293,967 | 10/1981 | Ord | 114/362 |
| 4,944,238 | 7/1990 | Lang | 114/61 |
| 5,152,238 | 10/1992 | Page | 114/143 |

*Primary Examiner*—Jesus D. Sotelo
*Attorney, Agent, or Firm*—Merrill N. Johnson

[57] ABSTRACT

The present invention provides manageable buoyancy and adjustable vessel draft which makes navigation possible in both shallow and deep waters without changing the total vessel weight or its given payload. The seakeeping characteristics and dynamic stability of the vessel are also managed by changing the shape of the buoyancy and by controlling corresponding wet vertical depth necessary for safe operations and navigation in both shallow and deep waters for all purposes. The ability to operate and navigate in both shallow and deep waters makes coastal boarding and unloading possible in shallow waters.

2 Claims, 4 Drawing Sheets

1-1
2-2
SHALLOW WATER
DEEP WATER
hsw

Fig.3A
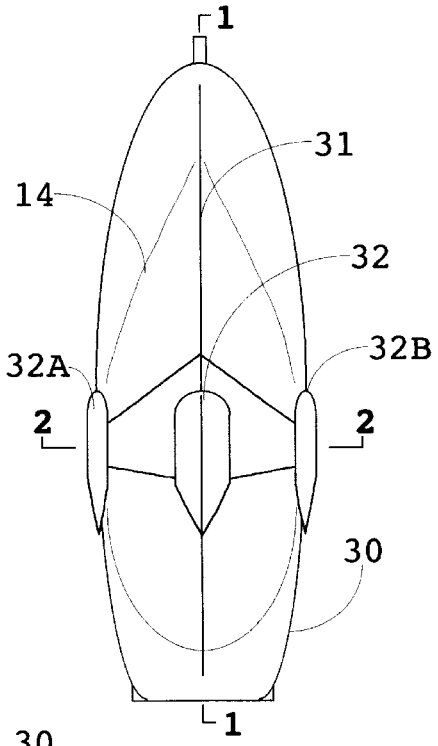
Fig.3
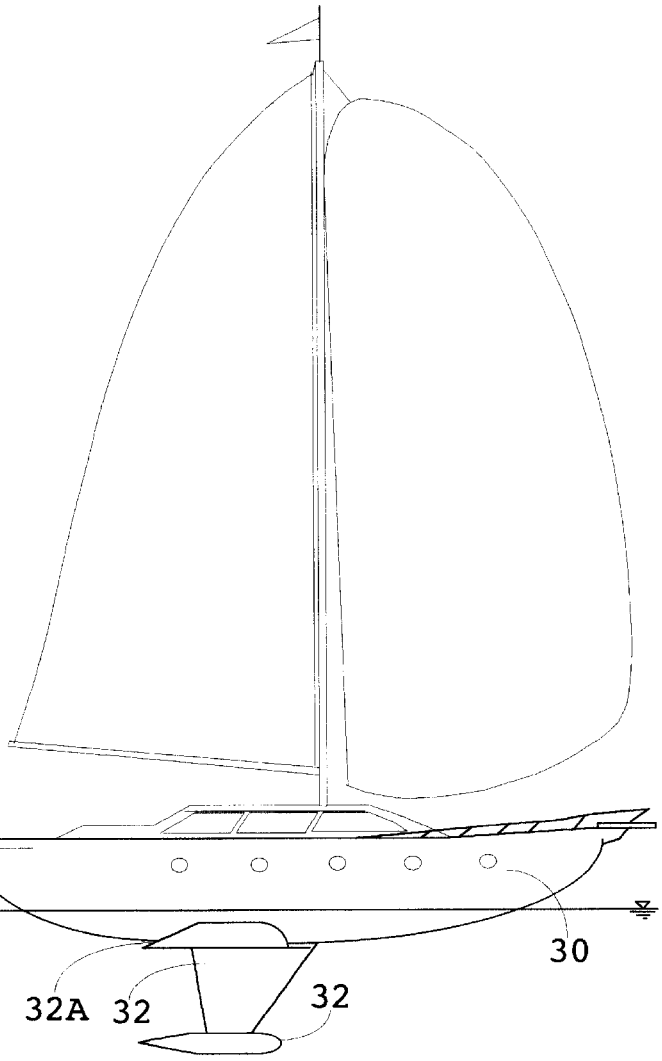
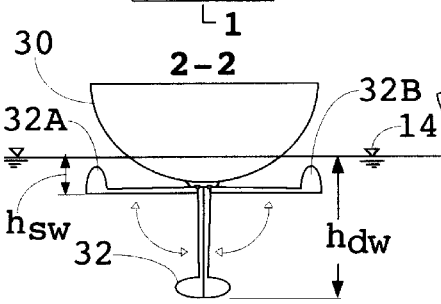
Fig.3B

APPARATUS FOR CONTROLLING THE BUOYANCY AND DRAFT OF A VESSEL

FIELD OF THE INVENTION

The present invention lies in the field of naval architecture and ocean engineering and more particularly to controlling the buoyancy and corresponding wet vertical depth (hereinafter draft) of a vessel without changing the vessel's total weight. The resulting adjustable draft permits navigation in both deep and shallow waters and makes coastal boarding and unloading of deep water ocean going vessels possible even in very shallow waters.

BACKGROUND OF THE INVENTION

There is a need for vessels which can operate in both deep and shallow waters. Large deep water vessels cannot be operated in shallow waters due to their draft. Vessels designed for shallow waters such as military landing craft cannot be safely operated in deep waters due to lack of seakeeping characteristics and the dynamic stability of their hulls.

For instant, in Florida the water depth of most estuarine and bay waters connected to the Gulf of Mexico range from two to five feet. These water bodies, which are well protected from waves and provide natural safe harbors, cannot be used by most deep water vessels due to their deep depth/draft.

The present invention provides adjustable vessel draft making navigation possible in both shallow and deep waters without changing the total vessel weight or its given payload.

The present invention also provides necessary deep water seakeeping characteristics and dynamic stability of the vessel by controlling its buoyancy and wet vertical depth necessary for safe operations and navigation in both shallow and deep waters for all purposes.

The present invention also provides a vessel operable in both deep and shallow waters that permits coastal boarding and unloading in very shallow waters when needed.

SUMMARY OF THE INVENTION

My invention controls both the buoyancy and the draft of a vessel without changing the vessel's weight, thus permitting safe navigation of the vessel in both deep and very shallow waters. My invention is usable on both vessels driven by mechanical means and vessels driven by the wind.

For vessels propelled by mechanical means, the vessel includes a central hull which houses the controls for operating the vessel and includes accommodations for passengers and/or cargo. In deep water the bottom of the central hull lies above the surface of the sea/water and the central hull is supported by a pair of adjustable side hulls connected to the opposite sides of the central hull.

The two elongated side hulls are hingedly connected to the central hull by a horizontally rotatable connector and each side hull has a center section, a front end and a rear end. Each front and rear end includes mechanical means for propelling the vessel forward or backward. When the vessel is operated in deep water, both adjustable side hulls are moved into a vertical position at 90° to the surface of the sea to provide dynamic stability to the central hull and propel the vessel as desired by the vessel's captain.

As the vessel is being moved into shallow waters, the side hulls are moved 90° from their vertical position to a position beneath or sides of the central hull so that the vessel's draft is markedly reduced to permit the vessel to maneuver in shallow water and thus discharge its cargo or take on cargo directly from a beach.

For vessels driven by the wind, the vessel has a main hull of conventional design including a keel. Beneath the lowermost portion of the keel are a pair of hingedly adjustable extended keels. By means of a pair of horizontally oriented rotatable connectors, the pair of extended keels can be moved 90° from a vertical position directly below the vessel's keel to horizontal positions on opposite sides of the main hull lying immediately beneath the surface of the sea/water.

When sailing in deep water the pair of extended keels are maintained in a vertical position to dynamically stabilize the vessel's main hull. However, as the vessel approaches shallow waters intending to navigate or discharge passengers and/or cargo directly onto the beach, the vertically oriented extended keels are rotated 90° into horizontal positions located on opposite sides of the main hull with the extended keels lying just beneath the surface of the sea/water.

BRIEF DESCRIPTION OF THE DRAWINGS

FIG. 3 is a side view of a further preferred embodiment of the present invention including sails, single hull and extended keels over line 1—1 of FIG. 3A.

FIG. 3A is a bottom plan view of FIG. 3 showing a draft management system including single hull and alternate positions of the extended keels.

FIG. 3B is a section view along line 2—2 of FIG. 3A showing a single hull and extended keels over representative deep and shallow water lines.

DETAILED DESCRIPTION OF THE PREFERRED EMBODIMENTS

Figure 1B:
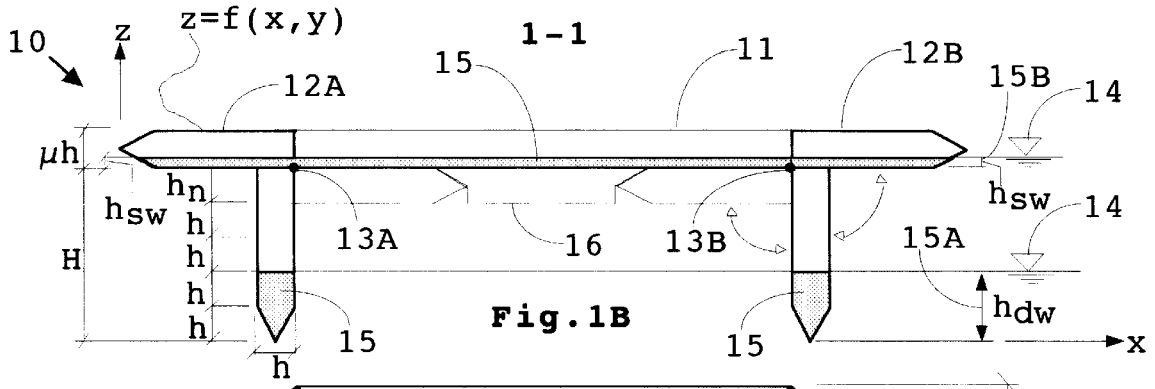
FIG. 1B is a section view along line 1—1 of FIG. 1 showing representative examples for the numerical and analytical demonstrations.
Figure 1A:
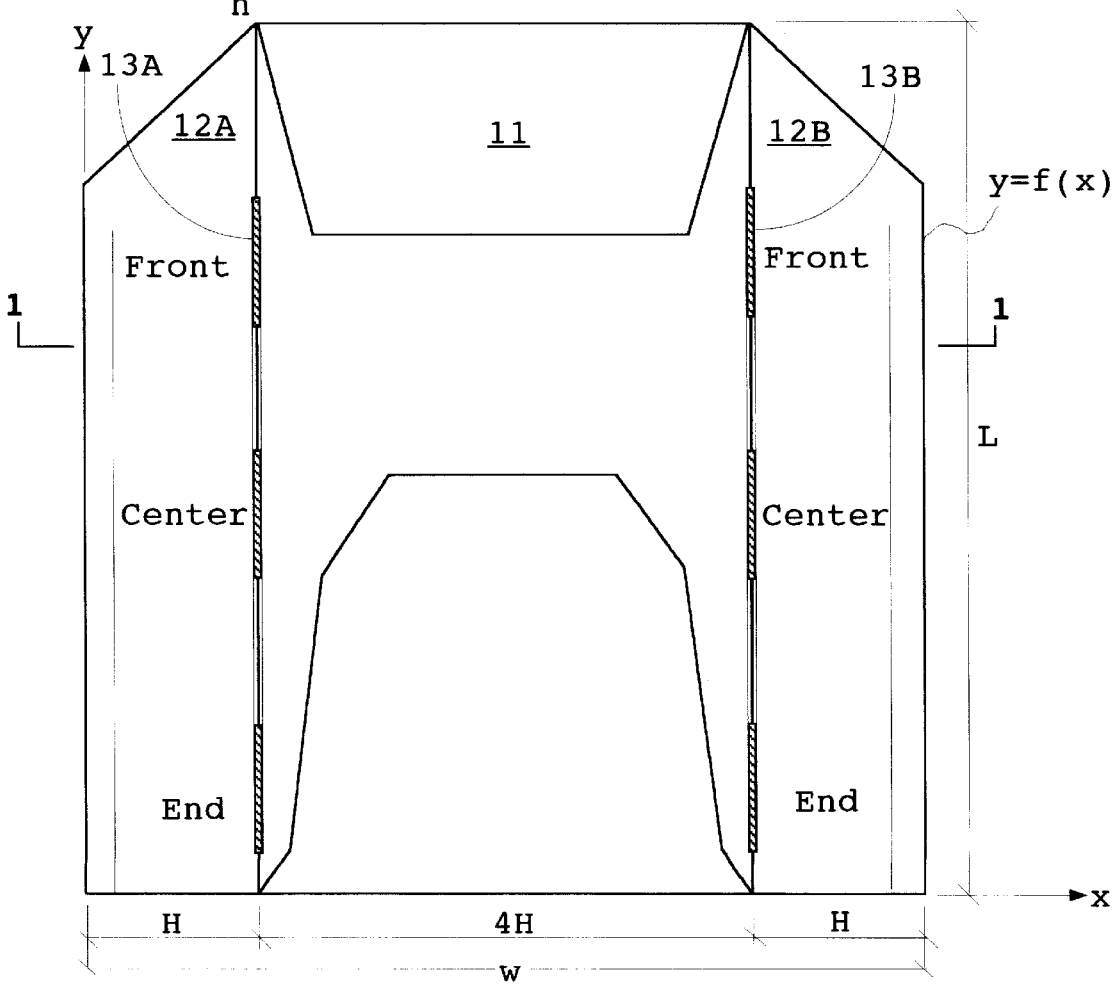
FIG. 1A is a plan view showing the general concept and major elements of my invention.

The general concept of my invention for buoyancy management and draft control of a preferred embodiment propelled by mechanical means are shown in FIG. 1A and FIG. 1B. A central hull 11 and side hulls 12A and 12B which represent any desired shape are shown in FIG. 1A and FIG. 1B. However, examples of relational variables in length such as unit h, and its multipliers k, m, n, c are chosen for numerical and analytical demonstrations only. Central hull 11 is connected to adjustable side hulls 12A and 12B along the axis 13A and axis 13B respectively over a water surface elevation 14. Total buoyancy 15 corresponds to a total draft ($h_{dw}$) 15A when hulls 12A and 12B are positioned for navigation in deep waters. Accordingly, when hulls 12A and 12B are positioned for navigation in shallow waters, total buoyancy 15 corresponds to a total draft ($h_{sw}$) 15B.

The side hulls 12A and 12B may also be positioned under 11 using attachment 16 to 11 where desired.

In the Systeme International (SI system), mass displacement can be shown as $\Delta=\rho V$, where $\Delta$ is in metric tons of a vessel mass, V in $m^3$ is the volume of displacement 15 to the waterline 14 at which the vessel is floating, and $\rho=1.00$ t/$m^3$ in fresh water and $\rho=1.026$ t/$m^3$ in salt water (or $\Delta=\delta V$ where $\delta$ is specific gravity or volume per unit mass since the mass density of fresh water is 1 kg/l or 1 t/$m^3$).

Assuming H=5h, w=30h, $h_{dw}$ =2h, dL=1m, the buoyancy 15 would be $V=(3\ h^2)\times L$ for corresponding deep water draft 15A, $h_{dw}$ =2h. The same buoyancy 15 would be necessary for the same $\Delta$. Therefore, shallow water draft 15B would be approximately $h_{sw}$ =(1/10) h since $V=w\times(h_{sw})\times L$, and $h_{sw}=3h^2/w$ where w=30h. Assuming h=1m, $h_{dw}$ would be 2 m (6.5 ft), and $h_{sw}$ would only be 10 cm (3.9 inches).

Figure 2:
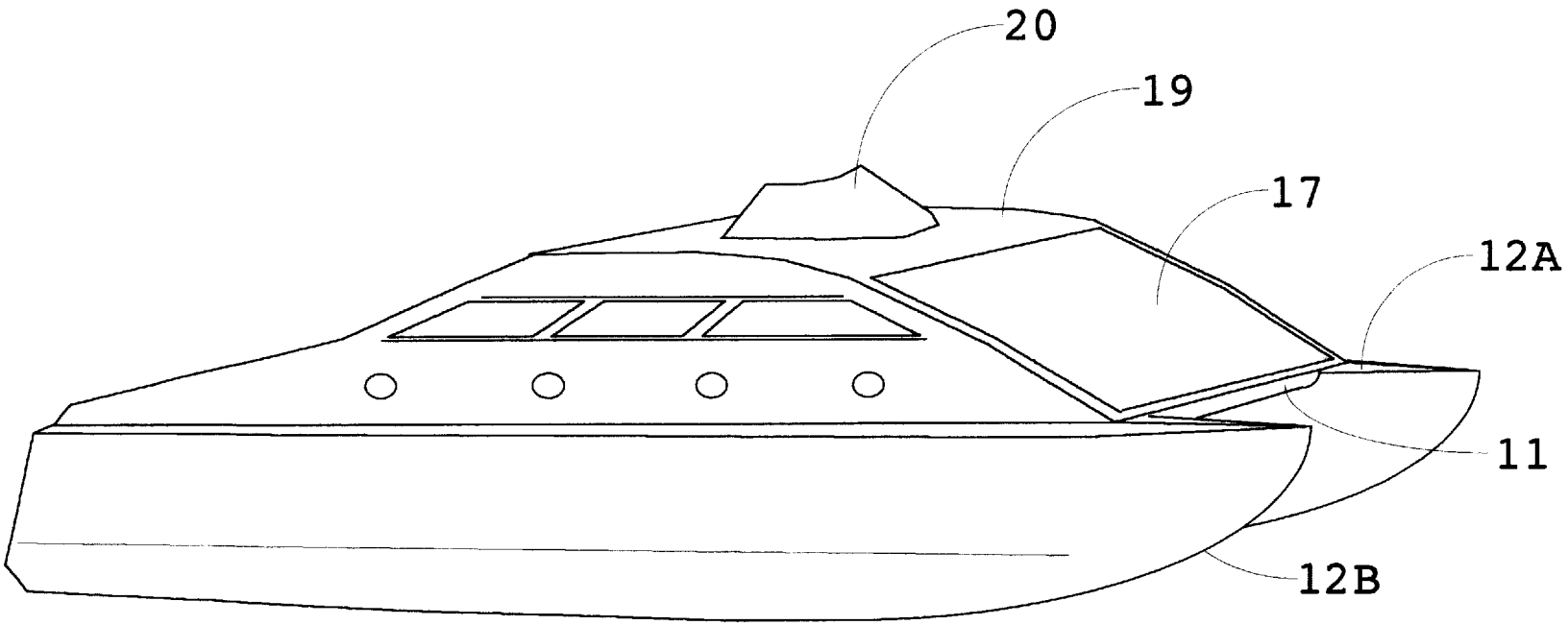
FIG. 2 is a perspective view of a preferred embodiment of the present invention.
Figures 2A, 2B, 2C, 2D:
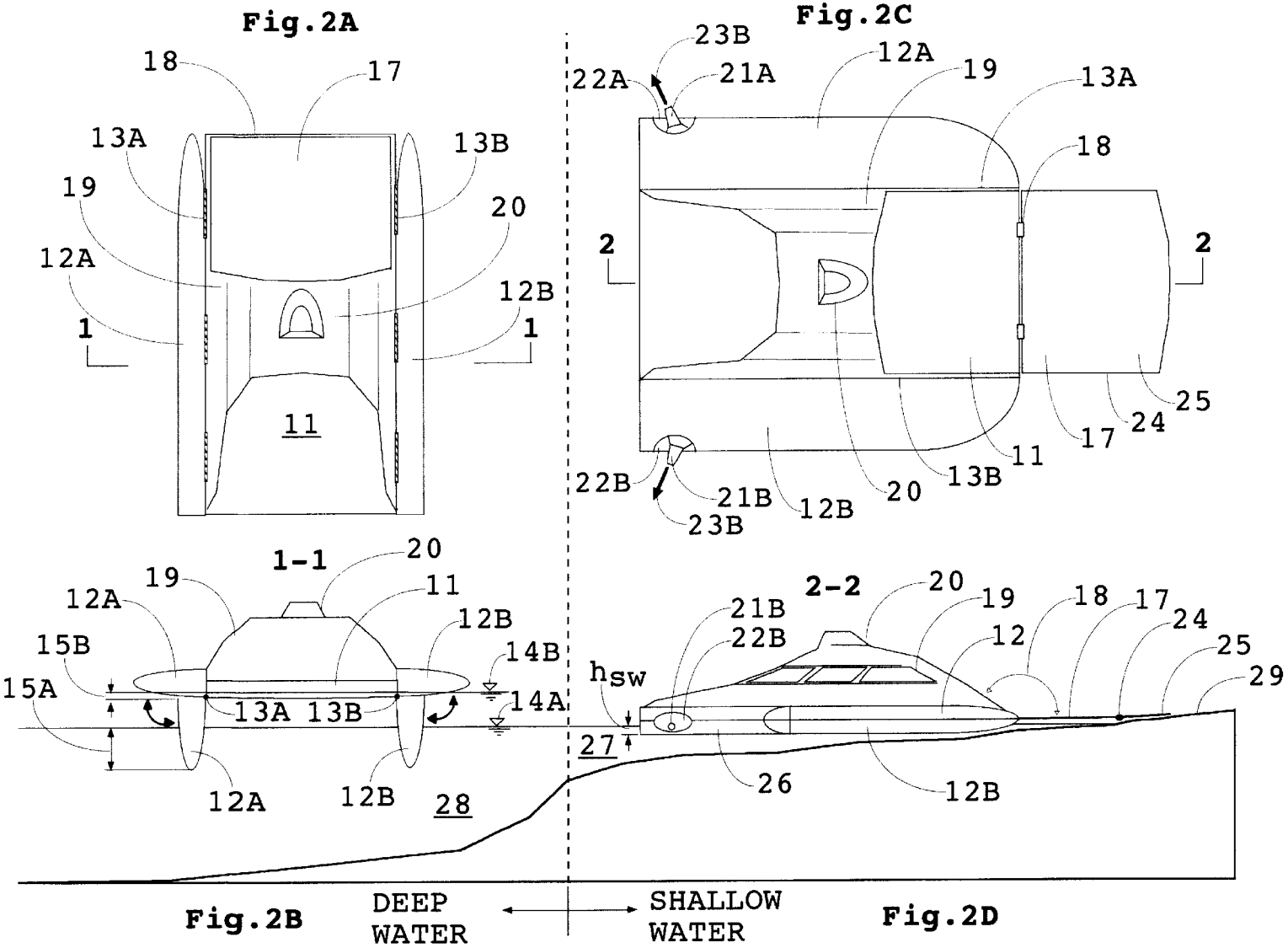
FIG. 2A is a plan view of a preferred embodiment of the present invention including multi hulls and surface extension(s) which are shown in deep waters conditions.
FIG. 2B is a section view along line 1—1 of FIG. 2A showing a buoyancy management and draft control system including hulls and a representative superstructure shown in deep waters conditions.
FIG. 2C is a plan view of a preferred embodiment of the present invention including multi hulls and surface extension(s), and dynamic stabilizers which are shown positioned in shallow waters conditions.
FIG. 2D is a section view along line 2—2 of FIG. 2B showing a boarding and loading/unloading system including hulls over a representative shallow water along a coastal line.

FIG. 2 is a perspective view of a preferred embodiment of the my invention which is propelled by mechanical means showing single hull 11, side hulls 12A and 12B, and superstructure 19 and 20. FIG. 2A shows a plan view of this preferred embodiment in deep waters conditions. FIG. 2B is a section view along line 1—1 of FIG. 2A which is shown in deep waters conditions 28. The side hulls 12A and 12B are positioned at 90 degrees from the water surface 14, and they are connected to single hull 11 along the axis 13A and 13B respectively. The draft $h_{dw}$ 15A in deep water conditions 28 is shown relative to the draft $h_{sw}$ 15B in shallow water conditions 27.

FIG. 2C is a plan view of the preferred embodiment of the present invention which is shown positioned in shallow waters conditions 27 including multi hulls and surface extension(s) 17, and dynamic stabilizers 21A and 21B placed in housing 22A and 22B respectively. The hull extension 17 is rotated along the axis 18 to demonstrate boarding and loading/unloading surface area. Upper structures 19 and 20 is also shown in relation to single hull 11 and side hulls 12A and 12B. The single hull 11 and side hulls 12A and 12B may be designed using any desired shape or curve for a given need. The dynamic stabilizers 21A and 21B can be positioned and adjusted to stabilize the vessel during the boarding and unloading using directional thrusters 23A and 23B. The thrust housings 22A and 22B are designed to provide hydrodynamic structure for 21A and 21B.

FIG. 2D is a section view along line 2—2 of FIG. 2C showing a boarding and loading/unloading system including hulls over a representative shallow water 27 along a coastal line 29. The draft 15B is achieved through a horizontal position of the side hulls 12A and 12B over water surface 14. The boarding and loading/unloading system including 17, 24, 25, and 18 are shown along a coastal line 29. An optional extension surface 25 attached to the main extension surface 17 using rotational connectors 24 is also shown in FIG. 2D. The side hulls 12A and 12B may be designed as needed so that a portion of the side hulls 26 may be rotated and positioned independently.

FIGS. 3, 3A, and 3B illustrate a second preferred embodiment of my invention in which the vessel is driven by the wind. The vessel has a single main hull 30 and a conventional keel 31. Beneath the lowermost portion of the keel are a pair of hingedly adjustable extended keels 32A and 32B over a water surface/level 14. By means of a pair of horizontally oriented rotatable connectors, the pair of extended keels can be moved 90° from a vertical position directly below the vessel's keel to horizontal positions on opposite sides of the main hull lying immediately beneath the surface of the sea/water. When sailing in deep water the pair of extended keels are maintained in a vertical position to dynamically stabilize the vessel's main hull. However, as the vessel approaches shallow waters intending to navigate or discharge passengers and/or cargo directly onto the beach, the vertically oriented extended keels are rotated 90° into horizontal positions located on opposite sides of the main hull with the extended keels lying just beneath the surface of the sea/water.

Navigating in deep waters with desired seakeeping characteristics and stability are achieved by positioning the extended keels 32A and 32B at a desired or maximum draft $h_{dw}$. Accordingly, navigating in shallow waters is achieved by positioning the extended keels 32A and 32B a desired or minimum draft $h_{sw}$.

While we have fully shown and described two embodiments of our apparatus for controlling the buoyancy and draft of a vessel, no limitations as to the scope of the present invention should be implied from the foregoing description. The true scope of the present invention is limited only by the following claims.

I claim:

1. A vessel designed for operation in deep water which can be navigated and boarded and unloaded in very shallow water comprising a main passenger and cargo carrying hull having two similar opposite sides, a pair of similar elongated side hulls each having a front end, a center section and a rear end which lie along the opposite sides of the main hull, each of the side hulls being connected to the main hull by a pair of similar horizontally oriented rotatable connectors which permit each side hull to rotate 90° from a horizontal position floating on the surface of the water along side the main hull to a vertical position beneath the water, and a pair of dynamic stabilizers mounted respectively on the right and left side hulls.

2. Apparatus according to claim 1 in which the main hull includes surface extensions at the front portion of the main hull which by means of rotatable connectors can be extended generally forward beyond the front portion of the main hull to permit boarding and unloading from the beach in shallow waters.

* * * * *